US011167832B2

(12) United States Patent
Doremus et al.

(10) Patent No.: US 11,167,832 B2
(45) Date of Patent: Nov. 9, 2021

(54) ELECTRICALLY PROPELLED WATERCRAFT WITH CORRESPONDING HULL ASSEMBLY

(71) Applicant: GM GLOBAL TECHNOLOGY OPERATIONS LLC, Detroit, MI (US)

(72) Inventors: Jonathan D. Doremus, Novi, MI (US); Chad Michael DuMars, Hermantown, MN (US); Preston C. Jackson, Clarkston, MI (US); John A. Diemer, Sterling Heights, MI (US); Briana M. Mohan, Clarkston, MI (US); Eric T. Wills, South Lyon, MI (US); Trevor Fayer, Milford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 190 days.

(21) Appl. No.: 16/598,032

(22) Filed: Oct. 10, 2019

(65) Prior Publication Data

US 2020/0255110 A1 Aug. 13, 2020

Related U.S. Application Data

(60) Provisional application No. 62/805,215, filed on Feb. 13, 2019.

(51) Int. Cl.

| | |
|---|---|
| ***B63H 21/17*** | (2006.01) |
| ***B63H 21/30*** | (2006.01) |
| ***B63B 1/10*** | (2006.01) |

(52) U.S. Cl.
CPC ..... *B63H 21/30* (2013.01); *B63B 1/10* (2013.01); *B63H 21/17* (2013.01)

(58) Field of Classification Search
CPC ..... B63H 21/30; B63H 21/17; B63B 1/10
See application file for complete search history.

(56) References Cited

U.S. PATENT DOCUMENTS

| | | | | |
|---|---|---|---|---|
| 4,996,937 | A * | 3/1991 | Niina | B63H 21/213 114/144 R |
| 5,419,274 | A * | 5/1995 | van Diepen | B63B 1/04 114/271 |
| 2006/0009092 | A1* | 1/2006 | Krietzman | B63H 21/17 440/6 |
| 2012/0137945 | A1* | 6/2012 | Armstrong | B63H 21/32 114/72 |
| 2016/0090154 | A1* | 3/2016 | Read | B63B 1/125 114/61.1 |
| 2017/0015397 | A1* | 1/2017 | Mitchell | H01M 10/6568 |

* cited by examiner

*Primary Examiner* — Stephen P Avila
(74) *Attorney, Agent, or Firm* — Cantor Colburn LLP

(57) ABSTRACT

A watercraft includes a hull structure, a deck structure, and a propulsion system. The hull structure includes at least one hull each defining an interior. The deck structure is mounted to the hull structure. The propulsion system is adapted for moving the watercraft within a body of water, and includes an electric motor and an energy storage device coupled to the electric motor. The electric motor and the energy storage device are positioned adjacent one another within an area including at least one of the interior of the at least one hull.

18 Claims, 7 Drawing Sheets

ELECTRICALLY PROPELLED WATERCRAFT WITH CORRESPONDING HULL ASSEMBLY

CROSS-REFERENCE TO RELATED APPLICATIONS

This application claims the benefit of 62/805,215 filed Feb. 13, 2019, which is incorporated herein by reference in its entirety.

INTRODUCTION

The subject disclosure relates to a watercraft, and more particularly to an electrically propelled watercraft with a corresponding hull assembly.

Existing electric propulsion watercrafts typically include an electric motor driven by electrical energy provided from one or more batteries. As a result, the range of the electrically driven watercraft is limited by the capacity of the batteries. The batteries of such a propulsion system are typically large and heavy, and are located on the deck of the watercraft, thereby using valuable deck space and creating a less than ideal center of gravity.

SUMMARY

In one exemplary embodiment, a watercraft includes a hull structure, a deck structure, and a propulsion system. The hull structure includes at least one hull each defining an interior. The deck structure is mounted to the hull structure. The propulsion system is adapted for moving the watercraft within a body of water, and includes an electric motor and an energy storage device coupled to the electric motor. The electric motor and the energy storage device are positioned adjacent one another within an area including at least one of the interior of the at least one hull.

In addition to one or more of the features described herein, the electric motor and the energy storage device are stacked along a longitudinal axis of the at least one hull.

In addition to one or more of the features described herein, the at least one hull includes a first hull having a first interior and a second hull having a second interior, the first interior defining a portion of the area.

In addition to one or more of the features described herein, the second interior is separate from the area.

In addition to one or more of the features described herein, the hull structure further comprises a compartment positioned directly adjacent the at least one hull, wherein an interior of the compartment is connected with an interior of the at least one hull to define the area.

In addition to one or more of the features described herein, the compartment forms a watertight connection with the at least one hull.

In addition to one or more of the features described herein, the compartment is integrally formed with the at least one hull.

In addition to one or more of the features described herein, the electric motor includes further comprises a motor shaft, an output shaft, and a coupling connecting the motor shaft and the output shaft such that the motor shaft and the output shaft rotate at a same speed.

In addition to one or more of the features described herein, the at least one hull includes a first hull having a first interior and a second hull having a second interior, the first hull and the second hull being symmetrical about a center plane of the hull structure.

In addition to one or more of the features described herein, at least one of the first hull and the second hull has a generally vertical inboard surface.

In addition to one or more of the features described herein, at least one of the first hull and the second hull has an outward lifting chine.

In addition to one or more of the features described herein, the at least one hull further comprises a third hull, the third hull being positioned between the first hull and the second hull.

In addition to one or more of the features described herein, wherein a deadrise of the third hull is less than 25 degrees.

In addition to one or more of the features described herein, the third hull further comprises a generally vertical outer surface and at least one chine.

In another exemplary embodiment, a hull structure of a watercraft having a propulsion system including an electric motor and an energy storage device for operating the electric motor includes at least one hull and at least one compartment having a hollow interior positioned directly adjacent the at least one hull. The hollow interior of the at least one compartment and an interior of the at least one hull are connected to form an area for receiving the electric motor and the energy storage device of the propulsion system.

In addition to one or more of the features described herein, the area is larger than the interior of the at least one hull.

In addition to one or more of the features described herein, the at least one hull includes a generally vertical inboard surface.

In addition to one or more of the features described herein, the at least one hull includes an outward lifting chine.

In addition to one or more of the features described herein, a deadrise of the at least one hull is less than 25 degrees.

In another exemplary embodiment, a watercraft a tri-hull structure, an energy storage device, and an electric motor. The tri-hull structure includes a port hull defining a port interior, a starboard hull defining a starboard interior, and a center hull defining a center interior. An area includes the port starboard and center interiors. The energy storage device is disposed in the area. The electric motor is disposed in the area, is powered by the energy storage device, and is adapted to propel the tri-hull structure.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
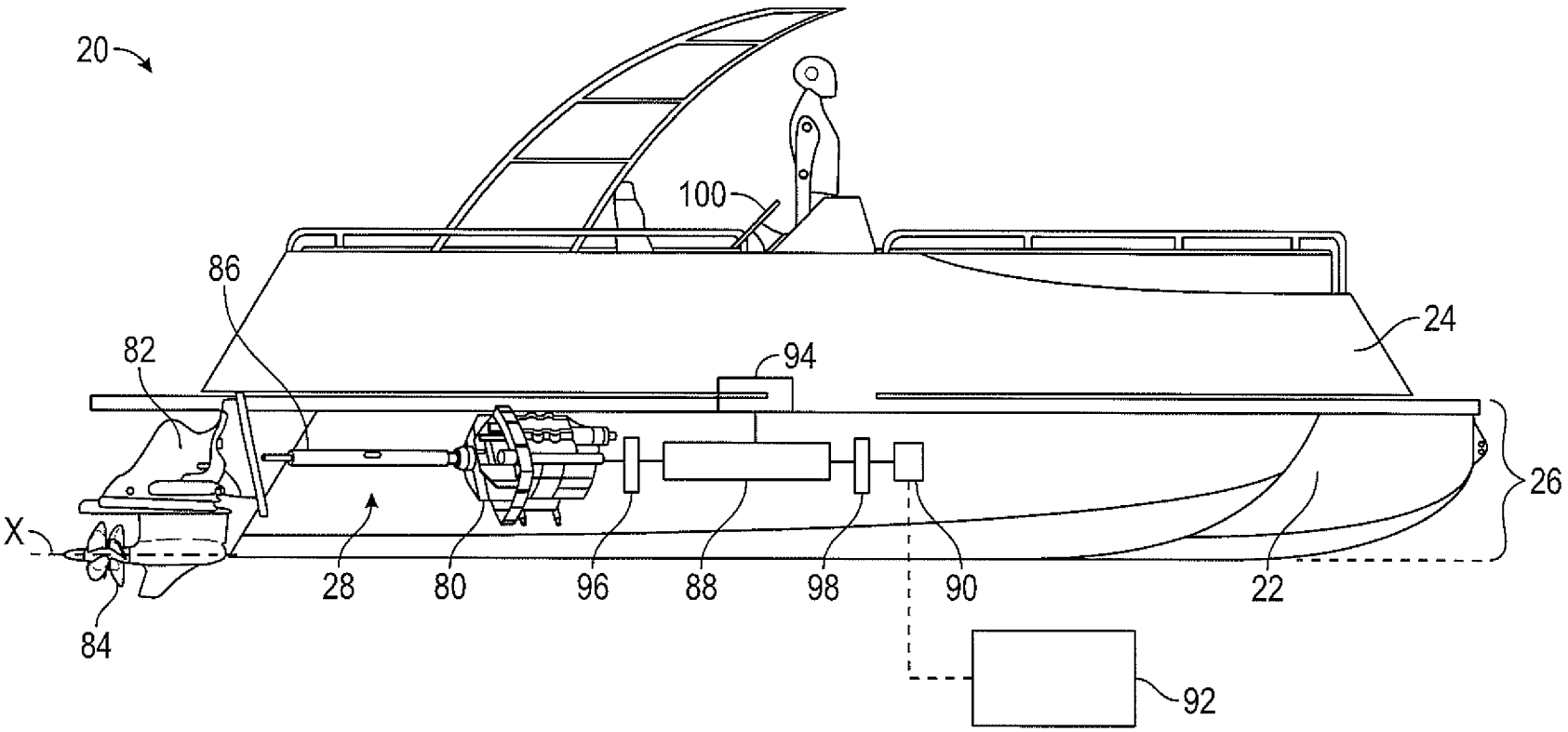
FIG. 1 is a schematic side view of a watercraft according to an embodiment.

The following description is merely exemplary in nature and is not intended to limit the present disclosure, its application or uses. It should be understood that throughout the drawings, corresponding reference numerals indicate like or corresponding parts and features.

In accordance with an embodiment, an electrically propelled watercraft 20, such as a boat or vessel for example, is illustrated in FIG. 1. As shown, the watercraft 20 includes a hull assembly 26 and a deck structure 24. The hull assembly 26 includes a hull structure 22 and a propulsion system 28 for propelling the watercraft 20 through a body of water. The hull structure 22 is adapted to structurally support and contain the propulsion system 28, and structurally support the deck structure 24, generally from below.

Figure 2:
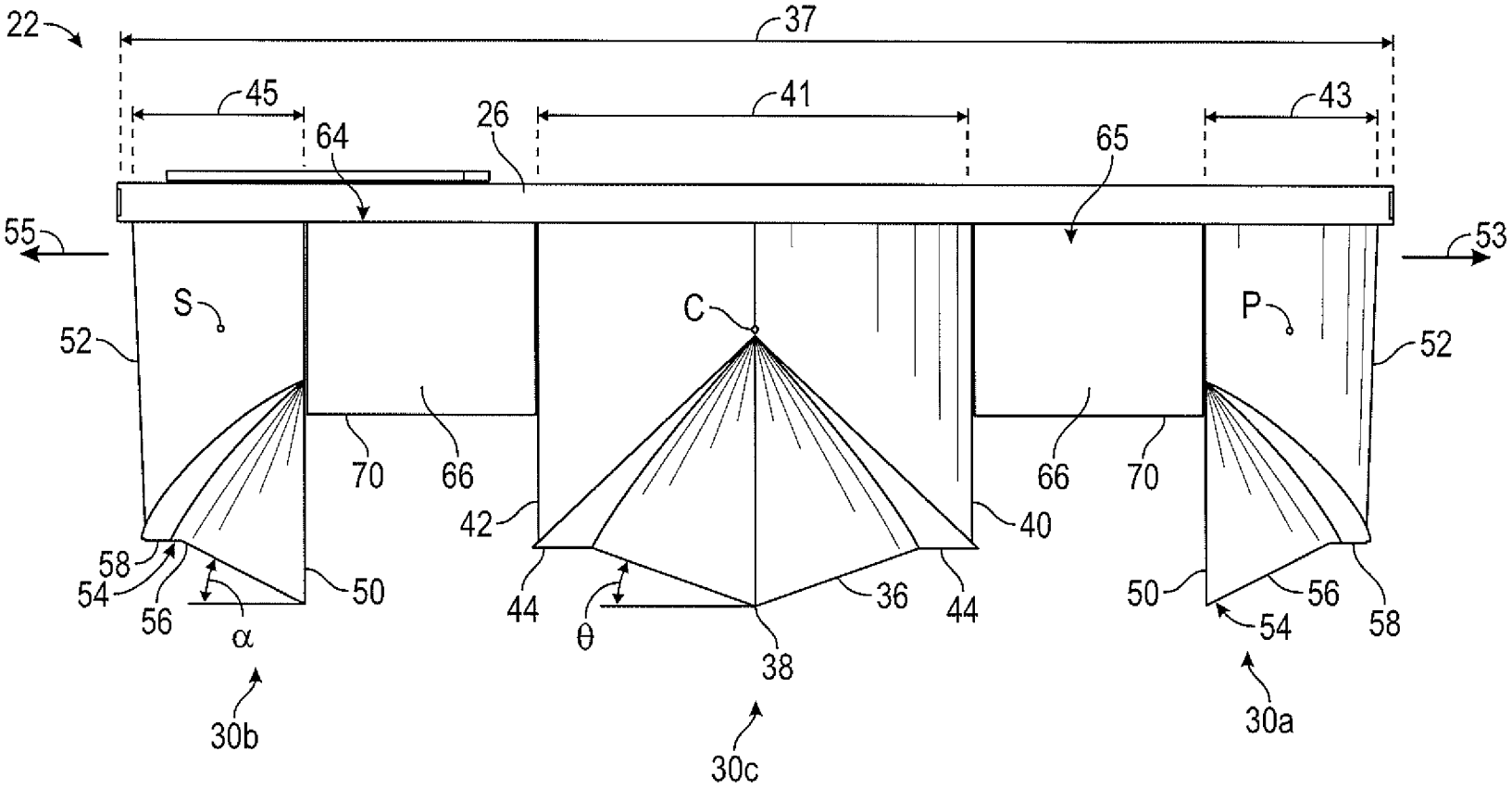
FIG. 2 is a front-end view of a hull structure of a watercraft according to an embodiment.

Referring now to FIG. 2, with continued reference to FIG. 1, the hull structure 22 of the hull assembly 26, in accordance with an embodiment, is shown in more detail. In the illustrated, non-limiting embodiment, the hull structure 22 has a multi-hull configuration including a port (left) hull 30*a*, a starboard (right) hull 30*b*, and a center hull 30*c*. The length of the plurality of hulls 30*a*, 30*b*, 30*c* may be substantially identical (i.e., forward to rearward), or alternatively may vary. In one embodiment, a length of the center hull 30*c* is greater than a length of the port and starboard hulls 30*a*, 30*b*. However, embodiments where the center hull 30*c* is shorter than, or equal in length to, the port and starboard hulls 30*a*, 30*b*, respectively, are also contemplated herein. Further, regardless of the length of the hulls 30*a*, 30*b*, 30*c*, the plurality of hulls 30*a*, 30*b*, 30*c* may be aligned, or may be staggered/offset, from one another. In the illustrated, non-limiting embodiment, sterns 32*a*, 32*b*, 32*c* (i.e., rearward end portions) of each one of the respective hulls 30*a*, 30*b*, 30*c* are generally aligned. However, alternative embodiments where bows 34*a*, 34*b*, 34*c* (i.e., forward end portions) of the respective hulls 30*a*, 30*b*, 30*c*, are aligned, or where a mid-point (not shown) taken along the length of each of the hulls 30*a*, 30*b*, 30*c* are aligned, is also within the scope of the disclosure.

Figure 3:
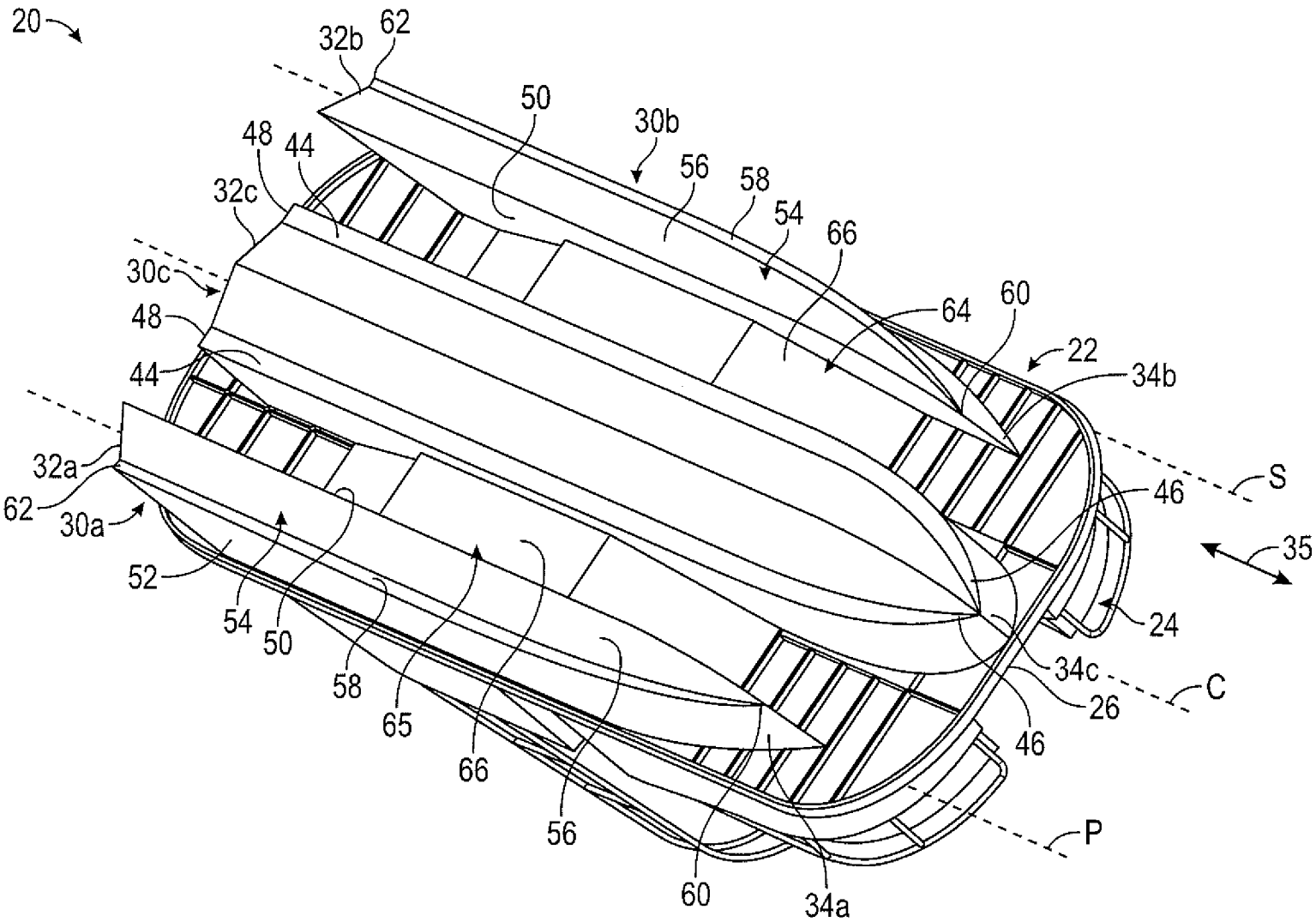
FIG. 3 is a perspective bottom view of a watercraft according to an embodiment.

Referring to FIG. 3, the port hull 30*a*, center hull 30*c*, and starboard hull 30*b* are each elongated in a forward to rearward direction (see arrow 35) and may be laterally spaced apart from one another along a beam (i.e., width, see arrow 37 in FIG. 2) of the watercraft 20 as measured at its widest point. The distance between a central axis P of the port hull 30*a* and a central axis C of the center hull 30*c* may be generally equal to the distance between the central axis C of the center hull 30*c* and a central axis S of the starboard hull 30*b*. In other embodiments, the hulls 30 may be non-uniformly spaced over the beam.

Figure 4:
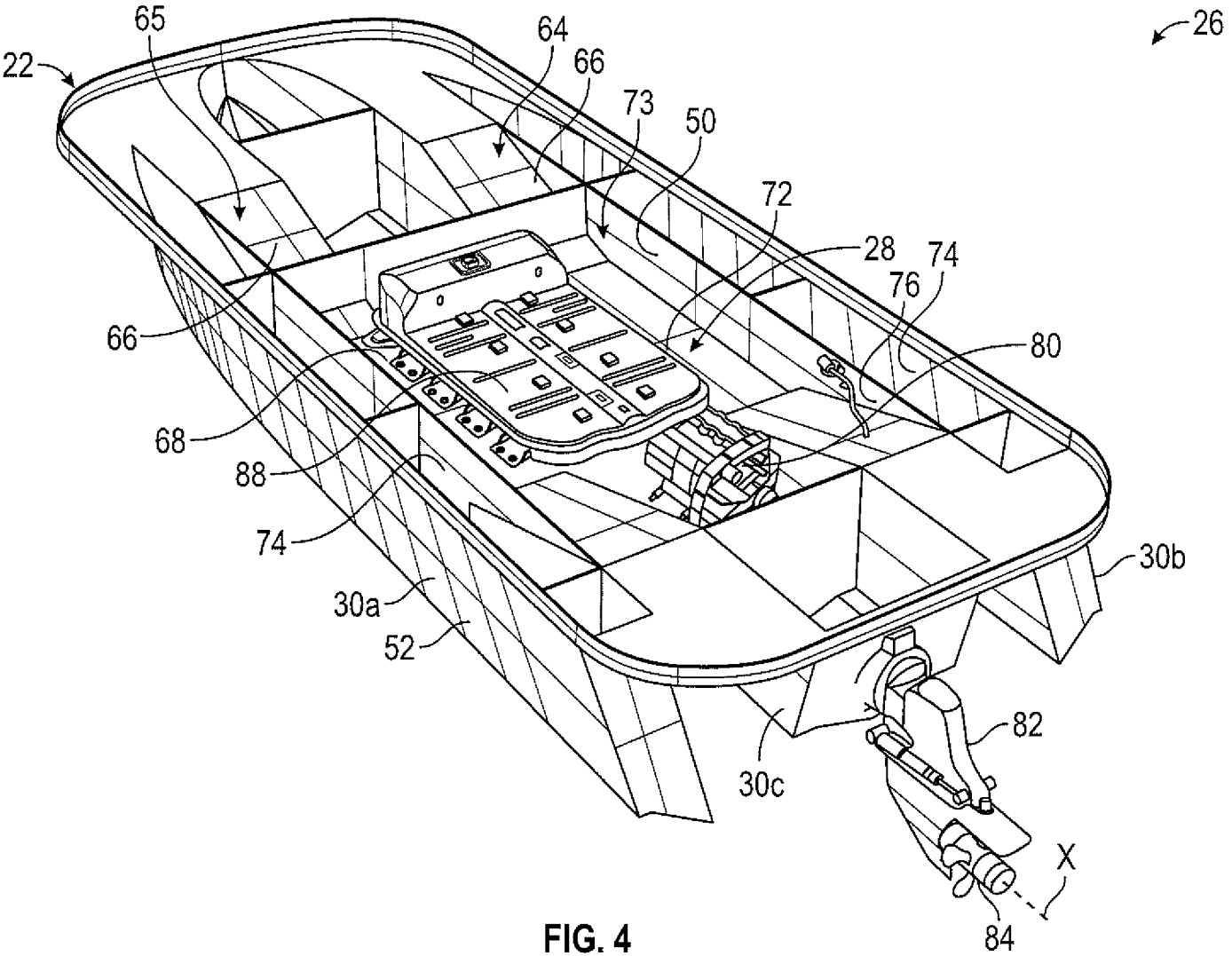
FIG. 4 is a perspective view of a propulsion system mounted within a hull structure according to an embodiment.

Referring to FIG. 4, the hulls 30*a*, 30*b*, 30*c* of the hull structure 22 of the hull assembly 26 may be integrally formed as one unitary piece. In other embodiments, the hulls 30*a*, 30*b*, 30*c* may be connected, such as via the deck structure 24. The hull structure 22 may be formed from any suitable material, such as fiberglass, aluminum, plastic, or a composite for example, using existing marine molding techniques.

Referring again to FIG. 2, and in accordance with an embodiment, the center hull 30*c* has a V-shaped bottom surface 36 extending from a center keel 38. In one embodiment, the V-shaped bottom surface 36 has a deadrise (shown as angle "θθ" in FIG. 2) formed between the bottom surface 36 and a horizontal plane on either side of the keel 38, within a range of about fifteen to twenty-five degrees (15°-25°), and in some embodiments about nineteen degrees (19°). However, any deadrise angle θ is within the scope of the disclosure.

The center hull 30*c* additionally includes a first outer surface 40 facing the port hull 30*a* and a second outer surface 42 facing the starboard hull 30*b*. Each of the first and second outer surfaces 40, 42 may, but need not have, a generally vertical configuration. In an embodiment, each of the first and second outer surfaces 40, 42 is oriented such that a chine 44 is formed at the interface between each of the outer surfaces 40, 42 and the bottom surface 36. That is, each chine 44 spans laterally between, and forms into, the respective outer surfaces 40, 42 and the bottom surface 36. In the illustrated, non-limiting embodiment, the chines 44 form about a ninety-degree angle with the respective outer surfaces 40, 42 of the center hull 30*c*. As best shown in FIG. 3, the chines 44 extend lengthwise along the center hull 30*c* from a chine first end portion 46 (i.e., forward end portion) to a chine second end portion 48 (i.e., rearward end portion). As shown, the chine first end portion 46 is arranged adjacent the bow 34*c* of the center hull 30*c* and the chine second end portion 48 is disposed near the stern 32*c* of the center hull 30*c*. However, embodiments where the chine 44 does not extend over the full length of the center hull 30*c* are also contemplated herein.

The center hull 30*c*, as illustrated and described herein, has a wide V-shaped configuration. With such a configuration, the wetted portion of the center hull 30*c* is reduced, thereby increasing the efficiency of the watercraft 20 as it moves through the water. It should be understood that the configuration of the center hull 30*c*, illustrated and described, herein is intended as an example only, and that other configurations are also within the scope of the disclosure.

Referring to FIG. 2, the configuration of the center hull 30*c* may be different than a configuration of at least one of the port hull 30*a* and the starboard hull 30*b*. A width (see arrow 41) of the center hull 30*c* is greater than a width (see arrow 43) of the port hull 30*a* and is greater than a width (see arrow 45) the starboard hull 30*b*. Further, in some embodiments the width 41 of the center hull 30*c* is greater than the combined widths 43, 45 of the port hull 30*a* and the starboard hull 30*b*.

In accordance with an embodiment, the port hull 30*a* and the starboard hull 30*b* may have a mirror configuration, such that the size and shape of the port and starboard hulls 30*a*, 30*b* are substantially identical and symmetrical about a center plane of the watercraft 20. Because of this symmetrical configuration of the port and starboard hulls 30*a*, 30*b*, the balance of the watercraft 20 about the center axis C of the center hull 30*c* may be optimized and may be improved over asymmetric configurations. However, embodiments where the configuration of the starboard hull 30*b* is distinct from the configuration of the port hull 30*a* are also contemplated herein.

Each of the port and starboard hulls 30*a*, 30*b*, include an inboard surface 50, an outboard surface 52, and a bottom surface 54 extending between the inboard and outboard surfaces 50, 52. In the illustrated, non-limiting embodiment, the inboard surfaces 50 of the port and starboard hulls 30*a*,

30*b* are generally vertical relative to a horizontal plane. The outboard surface 52 of the port hull 30*a* angles in a port direction (see arrow 53) as the outboard surface spans upward. Similarly, the outboard surface 52 of the starboard hull 30*b* angles in a starboard direction (see arrow 55) as the outboard surface spans upward.

In accordance with an embodiment, the bottom surfaces 54 of the port and starboard hulls 30*a*, 30*b* are each elongated along the direction 35 (see FIG. 3). Referring to FIGS. 2 and 3, each bottom surface includes an elongated first portion 56 and an elongated second portion 58 each co-extending longitudinally along direction 35. The first portion 56 laterally extends from the inboard surface 50 to the second portion 58, and the second portion 58 laterally extends from the outboard surface 52 to the first portion 56. The first portion 56 may be angled relative to both a horizontal plane and the second portion 58 of the bottom surface 54. In an embodiment, the angle of the first portion 56 relative to a horizontal plane, illustrated as "a" in FIG. 2, is within a range of about twenty to thirty-five degrees (20°-35°) and may be about twenty-seven degrees (27°).

The second portion 58 of the bottom surface 54 defines an elongated chine 58 co-extending longitudinally with the first portion 56 of the bottom surface 54 and in the general direction of arrow 35 (see FIG. 3). The chine 58 spans laterally between, and congruently forms into, the outboard surface 52 and the first portion 56. In one embodiment, the chine 58 forms about a ninety-degree (90°) angle with the outboard surface 52. Inclusion of the outward lifting chines 58 on the port and starboard hulls 30*a*, 30*b* allows water, specifically the wake formed by the hulls 30*a*, 30*b*, to be directed away from the underside of the hull structure 22. As shown in FIG. 3 and in one example, each chine 58 substantially extends longitudinally along the entire longitudinal length of the respective starboard and port hulls 30*a*, 30*b*, and from a chine first end portion 60 to a chine second end portion 62. It is appreciated that the shape of the hull and the chines illustrated are intended merely as examples, and that one skilled in the art will readily appreciate that the present disclosure may be applied to other hull shapes and configurations.

Figure 5C:
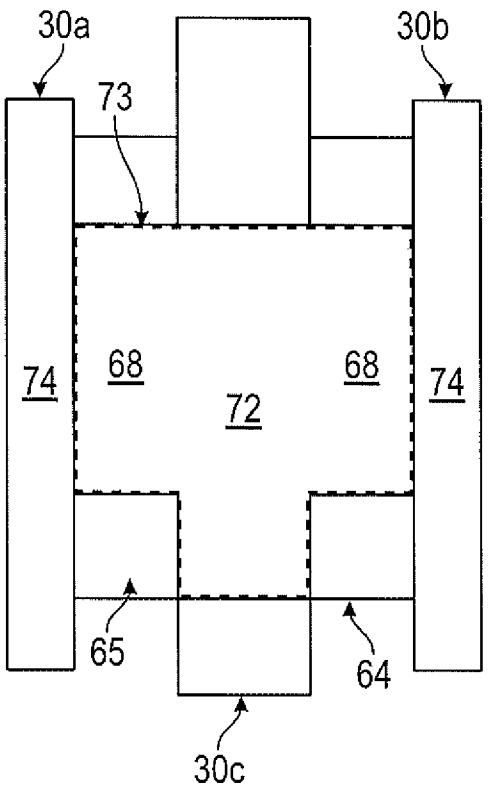
FIGS. 5A-5C are various schematic views of the hull structure according to an embodiment.
Figure 5B:
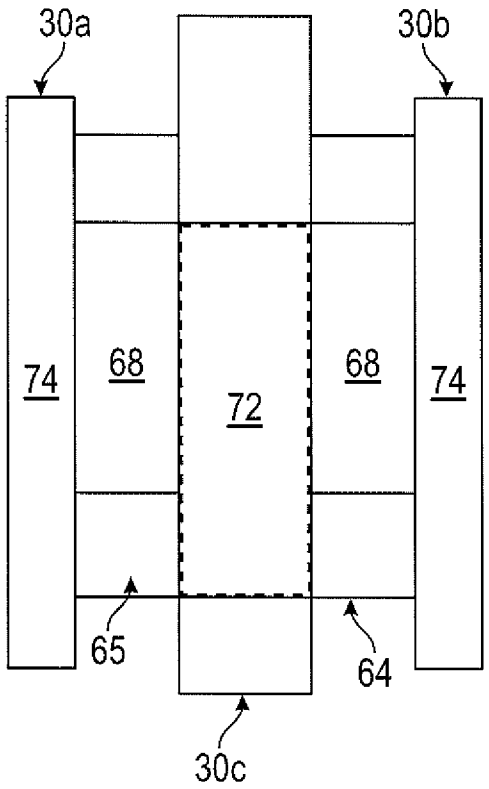
Figure 5A:
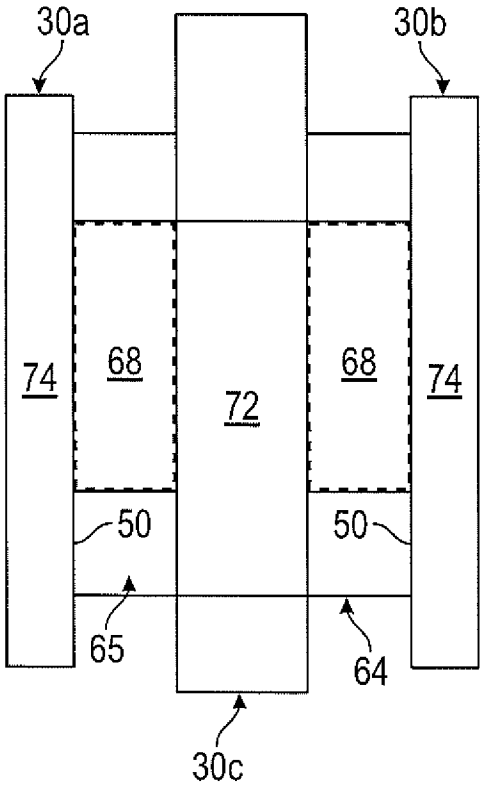

Referring to FIGS. 4 and 5A, and as one example, the hull structure 22 additionally includes one or more compartments (i.e., two illustrated as a starboard compartment 64 and a port compartment 65) each having an external body 66 (e.g., panel) contoured to define a hollow interior 68. The body 66 of the compartment 65 is positioned between, and engaged to, the port hull 30*a* and the center hull 30*c*. The body 66 of the compartment 64 is positioned between, and engaged to, the center hull 30*c* and the starboard hull 30*b*. The size and shape of the compartment 65 may be substantially identical to the size and shape of the compartment 64. In other examples, the hull structure 22 may include only one compartment that extends between, and connects, two hulls of a hull structure limited to two hulls.

In an embodiment, the body 66 of each compartment 64, 65 is sloped from a lower center, or mid, portion. That is, from the lower center portion, the body 66 may slope upwards and toward the bow, and from the lower center portion, the body may also slope upwards and toward the stern. As best shown in FIG. 4, the uppermost surface of the body 66 of each compartment 64, 65 may be aligned with an uppermost surface of one of the hulls 30*a*, 30*b*, 30*c*. Further, the depth of each compartment 64, 65 is less than the depth of the hull structure 22 such that when the watercraft 20 is in a body of water, the waterline of the hull structure 22 is disposed, and spaced, vertically below a bottom surface 70 of the compartments 64, 65 (see FIG. 2). However, embodiments where a portion of the compartments 64, 65 (e.g., the center portion) is submerged within a body of water are also within the scope of the disclosure.

As previously described, each of the compartments 64, 65 of the hull structure 22 has a hollow interior 68. The compartments 64, 65 are configured such that at least a portion of the interiors 68 (illustrated schematically by broken lines in FIG. 5A) is connected to, and is in fluid communication with, an interior 72 of the center hull 30*c* (illustrated schematically by broken lines in FIG. 5B). As a result, the interior 68 of the first compartment 64, the interior 68 of the second compartment, and the interior 72 of the adjacent center hull 30*c* are all combined to define an area 73 (illustrated schematically in broken lines in FIG. 5C). As a result, the overall size of the area 73 (i.e., continuous space) available for storing one or more components within the hull structure 22 is increased.

In embodiments where the compartment is positioned between two hulls, such as hull 30*a* and 30*c* for example, the compartment 64 may be in communication with interiors 74 of both hulls 30*a*, 30*c*. As shown in FIGS. 5A-5C, the interior 68 of the compartment 64 is isolated from the interior 74 of the port hull 30*a* by the inboard surface 50 of the port hull 30*a*. However, embodiments where one or more of the compartments 64, 65 are open to the interiors 74 of the port and/or starboard hulls 30*a*, 30*b*, in addition to, or in place of the interior 72 of the center hull 30*c* are also contemplated. However, it should be understood that embodiments of the hull structure 22 including only a single compartment 64 are also within the scope of the disclosure.

In an embodiment, the body 66 of the one or more of the compartments 64, 65 may be formed (i.e., manufactured) separately from the remainder of the hull structure 22, and may be later connected to a portion of the hull structure 22, such as to an adjacent hulls. In such embodiments, the interface between the body 66 and the hull structure 22 is sealed to form a watertight connection. Alternatively, the compartment 64 may be integrally formed with one or more hulls of the hull structure 22. In such embodiments one or more walls isolating the interior(s) 68 of the compartment(s) 64, 65 from the interior of an adjacent hull, such as the interior 74 of the port or starboard hull 30*a*, 30*b* for example, may also be integrally formed with the hull structure 22, or may be dividers 76 (see FIG. 4) installed into the hull structure 22 to define distinct areas therein. It is contemplated and understood that the dividers 76 may carry a portion of the interior surface 50.

Advantages and benefits of the present disclosure include a hull structure 22 that is more energy efficient than existing hull structures. As previously noted, the hull structure 22 has a reduced wetted surface area, due largely in part to the deadrise of the center hull 30*c*. In addition, the hull structure 22 has a flatter planning surface than more traditional hull structures, allowing the watercraft 20 to more easily glide on top of the water (i.e., plane) during operation, and therefore travel at greater speeds.

In addition, the hull structure 22 has enhanced maneuverability relative to existing hull structures. At least in-part, maneuverability enhancements are facilitated by the V-shape of the center hull 30*c* that cuts waves and pushes the water away from the hull structure 22. The larger center hull 30*c*, relative to the port and starboard hulls 30*a*, 30*b*, increases the stability of the watercraft 20, thereby reducing the susceptibility to water chop or rocking, and the depth of the center hull 30*c* allows the watercraft to corner at high speeds. This increased maneuverability enables the hull structure 22 to be used in several different types of watercraft. For example, a deck structure 24 commonly used in pontoon boats may be affixed to the hull structure 22. Alternatively, a deck structure 24 commonly used in fishing vessels, or a deck structure 24 commonly use in speed boats, may also be mounted to the hull structure 22.

Although the hull structure 22 illustrated and described herein has a tri-hull configuration, embodiments of the watercraft 20 having a single hull configuration, a bi-hull configuration, or a configuration with more than three hulls are within the scope of the disclosure.

Figure 6:
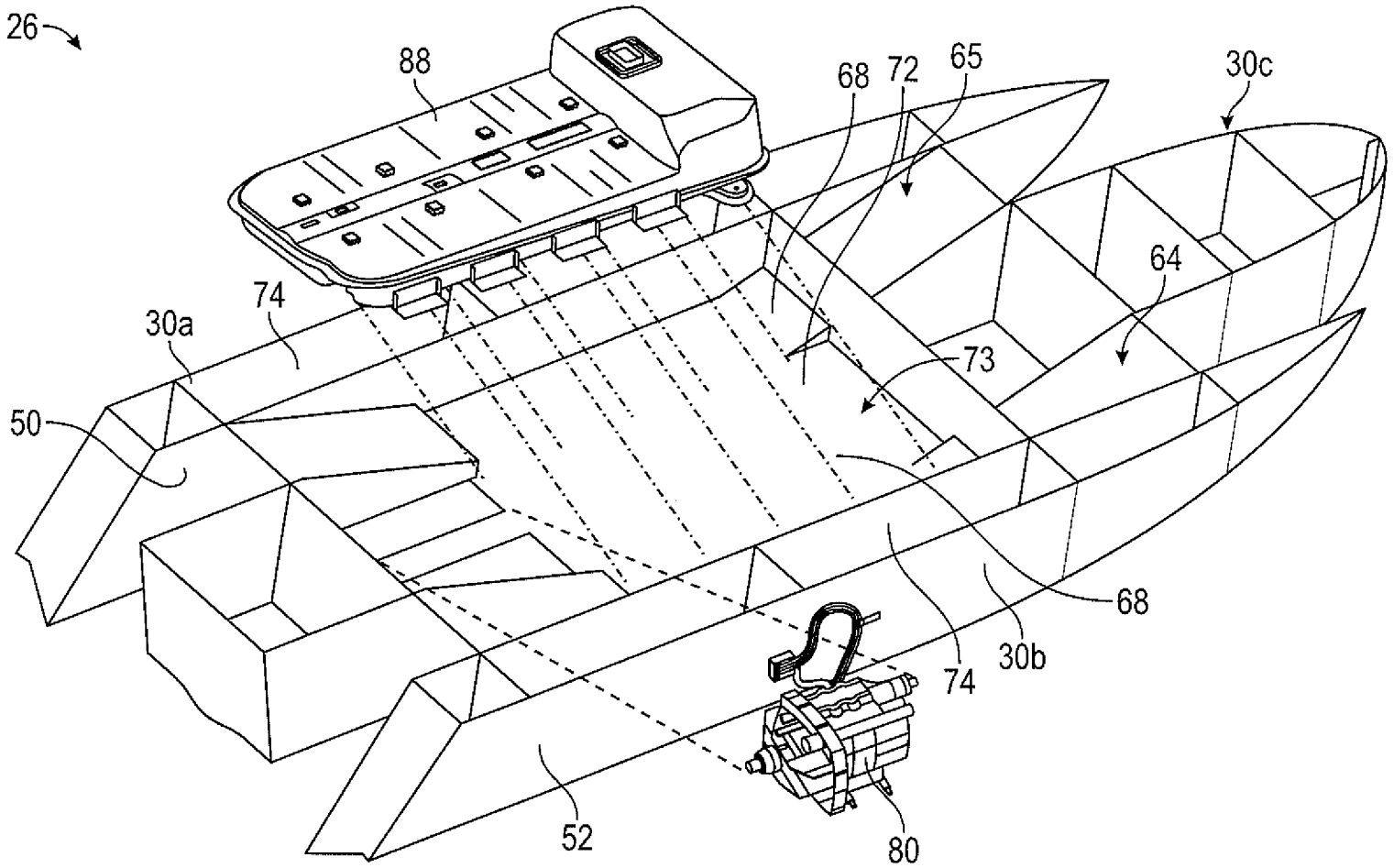
FIG. 6 is a perspective, partially expanded view of a propulsion system mounted within a hull structure according to an embodiment.
Figure 7:
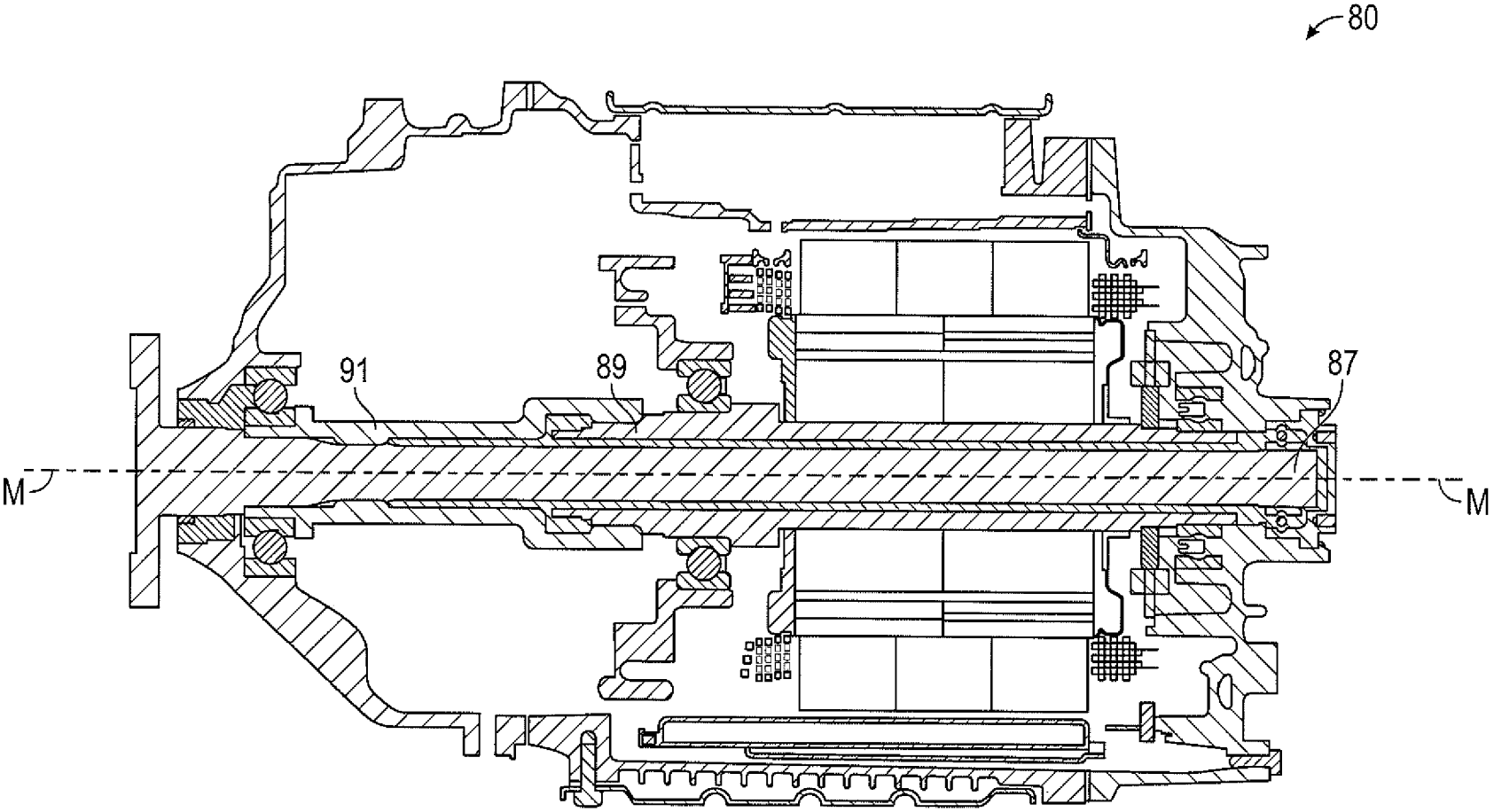
FIG. 7 is a cross-sectional view of an electric motor of a propulsion system of a watercraft according to an embodiment.

With continued reference to FIGS. 1, 4, and 6, the propulsion system 28 of the hull assembly 26, in accordance with an embodiment, is shown in more detail. In an embodiment, the propulsion system 28 includes an electric motor 80 connected to a stern drive 82 that propels the watercraft 20 via rotation of a propeller 84 about a propeller axis X. The electric motor 80 may be connected to the stern drive 82 via a drive shaft 86, or, in some embodiments, the drive shaft 86 may be omitted and the electric motor 80 and the stern drive 82 are directly connected. With reference to FIG. 7, an output shaft 87 of the electric motor 80 is connected to the drive shaft 86. In an embodiment, the output shaft 87 is directly driven by a motor shaft 89 about a motor axis M. A coupling mechanism 91 may connect the motor shaft 89 and the output shaft 87 such that the output shaft 87, the motor shaft 89, and the drive shaft 86, rotate in the same direction at the same rotational speed. In an embodiment, the coupling mechanism 91 provides a splined connection between the output shaft 87 and the motor shaft 89. However, embodiments where the output shaft 87 and the drive shaft 86 rotate at different speeds about the axis M, such as via a geared transmission (not shown), are also within the scope of the disclosure. Operation of the electric motor 80 drives rotation of the drive shaft 86, which in turn rotates the propeller 84 either directly or via intermediate connections, or gear reduction arrangements (not shown).

The electric motor 80 is powered by an energy storage device 88. The energy storage device 88 may be a battery system (e.g., a battery or bank of batteries), fuel cells, flow battery, and other devices capable of storing and outputting electric energy. The energy storage device 88 is periodically recharged via, for example, an outlet 90 connected to a power source 92 when the watercraft 20 is docked, or on shore (see FIG. 1).

In one example, the propulsion system 28 further includes an accessory power module (APM) 94 operable to convert 350V DC to 12V DC power to charge an onboard 12V electrical system, a single power inverter module (SPIM) 96 that converts the 350V DC power to 3 phase AC power to power the electric motor 80, and onboard charging module (OBCM) 98 that converts AC power from the grid to DC power to charge the energy storage device 88.

In accordance with an exemplary embodiment, the propulsion system 28 is arranged within an interior of the hull structure 22 and is operably connected to one or more controls 100 (see FIG. 1) operable by a user of the watercraft 20. In an embodiment, several or even all of the components of the propulsion system 28 may be integrated into a single location of the hull structure 22. As best shown in FIGS. 4, 5*c*, and 6, the electric motor 80 and the energy storage device 88 of the propulsion system 28 are disposed within the area 73 formed by the interior 72 of the center hull 30*c* and the interior 68 of at least one adjacent compartment 64, 65. The energy storage device 88 and the electric motor 80 may be stacked relative to one another along the central axis C (see FIG. 2) defined by the center hull 30*c*. However, embodiments, where the energy storage device 88 and the electric motor 80 are arranged side-by-side, or in another configuration are also contemplated herein. Further, in embodiments including a drive shaft 86 extending between the electric motor 80 and the stern drive 82, at least a portion of the drive shaft 86 may similarly be positioned within the interior 72 of the center hull 30*c* and the interior 68 of adjacent compartments 64, 65.

By mounting the major components of the propulsion system 28 within the hull structure 22, at a single location, the overall configuration of the propulsion system may be streamlined, and access to the propulsion system for maintenance may be more easily achieved via a panel in the deck structure 24. Furthermore, the hull assembly 26 takes the form of a module design that includes the hull structure 22 and the propulsion system 28, while maintaining the ability to couple with any number of different deck structures 24.

While the above disclosure has been described with reference to exemplary embodiments, it will be understood by those skilled in the art that various changes may be made, and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed but will include all embodiments failing within the scope thereof.

What is claimed is:

1. A watercraft comprising:

a hull structure including at least one hull each defining an interior;

a deck structure mounted to the hull structure; and a propulsion system for moving the watercraft within a body of water, the propulsion system including an electric motor and an energy storage device coupled to the electric motor, wherein the electric motor and the energy storage device are positioned adjacent one another within an area including at least one of the interior of the at least one hull, wherein the electric motor and the energy storage device are stacked along a longitudinal axis of the at least one hull.

2. The watercraft of claim 1, wherein the at least one hull includes a first hull having a first interior and a second hull having a second interior, the first interior defining a portion of the area.

3. The watercraft of claim 2, wherein the second interior is separate from the area.

4. The watercraft of claim 1, wherein the hull structure further includes a compartment positioned directly adjacent the at least one hull, wherein an interior of the compartment is connected with an interior of the at least one hull to define the area.

5. A watercraft comprising:

a hull structure including at least one hull each defining an interior;

a deck structure mounted to the hull structure; and a propulsion system for moving the watercraft within a body of water, the propulsion system including an electric motor and an energy storage device coupled to the electric motor, wherein the electric motor and the energy storage device are positioned adjacent one another within an area including at least one of the interior of the at least one hull, wherein the hull structure further includes a compartment positioned directly adjacent the at least one hull, wherein an interior of the compartment is connected with an interior of the at least one hull to define the area, and wherein the compartment forms a watertight connection with the at least one hull.

6. The watercraft of claim 4, wherein the compartment is integrally formed with the at least one hull.

7. The watercraft of claim 1, wherein the electric motor further includes a motor shaft, an output shaft, and a coupling connecting the motor shaft and the output shaft such that the motor shaft and the output shaft rotate at a same speed.

8. The watercraft of claim 1, wherein the at least one hull includes a first hull having a first interior and a second hull having a second interior, the first hull and the second hull being symmetrical about a center plane of the hull structure.

9. The watercraft of claim 8, wherein at least one of the first hull and the second hull has a generally vertical inboard surface.

10. The watercraft of claim 8, wherein at least one of the first hull and the second hull has an outward lifting chine.

11. The watercraft of claim 8, wherein the at least one hull further includes a third hull, the third hull being positioned between the first hull and the second hull.

12. A watercraft comprising:

a hull structure including at least one hull each defining an interior;

a deck structure mounted to the hull structure; and a propulsion system for moving the watercraft within a body of water, the propulsion system including an electric motor and an energy storage device coupled to the electric motor, wherein the electric motor and the energy storage device are positioned adjacent one another within an area including at least one of the interior of the at least one hull, wherein the at least one hull includes a first hull having a first interior and a second hull having a second interior, the first hull and the second hull being symmetrical about a center plane of the hull structure, wherein the at least one hull further includes a third hull, the third hull being positioned between the first hull and the second hull, and wherein a deadrise of the third hull is less than 25 degrees.

13. The watercraft of claim 11, wherein the third hull further includes a generally vertical outer surface and at least one chine.

14. A hull structure of a watercraft having a propulsion system including an electric motor and an energy storage device for operating the electric motor, the hull structure comprising:

at least one hull; and at least one compartment including a hollow interior positioned directly adjacent the at least one hull, wherein the hollow interior of the at least one compartment and an interior of the at least one hull are connected to form an area for receiving the electric motor and the energy storage device of the propulsion system, wherein the area is larger than the interior of the at least one hull.

15. The hull structure of claim 14, wherein the at least one hull includes a generally vertical inboard surface.

16. The hull structure of claim 14, wherein the at least one hull includes an outward lifting chine.

17. The hull structure of claim 14, wherein a deadrise of the at least one hull is less than 25 degrees.

18. A watercraft comprising:

a tri-hull structure including a port hull defining a port interior, a starboard hull defining a starboard interior, and a center hull defining a center interior, wherein a single area includes the port, starboard, and center interiors, and wherein the port, starboard, and center-interiors are in communication with one-another to form the single area;

an energy storage device disposed in the single area; and an electric motor disposed in the single area, powered by the energy storage device, and adapted to propel the tri-hull structure.

* * * * *